United States Patent [19]

Ratzloff et al.

[11] Patent Number: 4,467,925

[45] Date of Patent: Aug. 28, 1984

[54] WHEELBARROW AND GARDEN TOOL STORAGE RACK

[76] Inventors: Harry Ratzloff, P.O. Box 381, Turner, Oreg. 97392; Jacob J. Reimer, 105 W. Vesper, Hesston, Kans. 67062

[21] Appl. No.: 325,851

[22] Filed: Nov. 30, 1981

[51] Int. Cl.[3] ..... A47F 5/08

[52] U.S. Cl. ..... 211/60 T; 211/94; 211/103; 248/214; 248/228

[58] Field of Search ..... 211/60 T, 18, 19, 87, 211/94, 207, 162, 103, 66, 65, 175, 182; 248/228, 214, 295.1, 298

[56] References Cited

U.S. PATENT DOCUMENTS

| | | | |
|---|---|---|---|
| 2,665,869 | 1/1954 | Samuels | 211/87 X |
| 2,959,297 | 11/1960 | Larson | 211/182 X |
| 3,202,292 | 8/1965 | Deliso | 211/87 |
| 3,729,627 | 4/1973 | Littell | 248/298 X |
| 3,915,851 | 10/1975 | Ratzloff et al. | 211/88 |
| 4,136,782 | 1/1979 | Hugel | 211/19 |
| 4,318,486 | 3/1982 | Bobrowski | 211/87 |

FOREIGN PATENT DOCUMENTS

| | | | |
|---|---|---|---|
| 2659818 | 10/1977 | Fed. Rep. of Germany | 248/295.1 |
| 2390925 | 1/1979 | France | 248/295.1 |
| 285862 | 5/1931 | Italy | 211/60 T |

*Primary Examiner*—Ramon S. Britts
*Assistant Examiner*—Robert W. Gibson, Jr.
*Attorney, Agent, or Firm*—James D. Givnan, Jr.

[57] ABSTRACT

A rack is disclosed for placement on a wall surface for the suspended storage of garden tools and a wheelbarrow. A horizontal rack member slidably receives multiple brackets on which the heads of the stored tools may rest. Sleeves having wire bails are also slidably mounted on the horizontal rack member and receive the handles of a wheelbarrow. A vertical rack member is coupled to the first mentioned rack member and is provided with a wheelbarrow support in a manner offsetting the wheelbarrow from the wall permitting tools to be stored between the wheelbarrow and the supporting wall surface.

3 Claims, 5 Drawing Figures

WHEELBARROW AND GARDEN TOOL STORAGE RACK

BACKGROUND OF THE INVENTION

The present invention pertains generally to tool storage racks and particularly to a storage rack for attachment to a wall such as that of a garage or small storage shed.

Prior art tool storage racks are presently available comprising a horizontally disposed rail for securement to a wall surface. Slidably mountable along the rail are a plurality of brackets of hook configuration on which may be hung various types of garden tools. Of the known commercial available storage racks, none provide the capability of storing both a wheelbarrow and garden tools in an upright manner adjacent a wall surface. The brackets provided with known racks are not capable of supporting a wheelbarrow in an upright position. Further, no provision is made for the support of the lowermost end of a wheelbarrow stowed adjacent a wall surface. U.S. Pat. No. 3,915,308 issued to the present inventors discloses a wheelbarrow rack which may be modified for the storage of garden tools, however, no provision is made for the simultaneous storage of both a wheelbarrow and tools.

SUMMARY OF THE PRESENT INVENTION

The present invention is embodied within a wall mounted storage rack having horizontal and vertical members adapted to support a wheelbarrow in spaced relationship to an adjacent wall surface while permitting the storage of several garden tools between the wheelbarrow and the wall surface.

The present rack includes a horizontal member from which an intersecting vertical member depends to provide a T-shaped rack. The horizontal member is suitably mounted by brackets to a wall surface with the vertical member depending from a connector slidably mounted on the horizontal member. The vertical member of the rack in turn receives a slidably mounted sleeve which carries a support bracket for the wheelbarrow. Bails are adjustably mounted along the horizontal member of the rack to adapt the rack to various sizes of wheelbarrows and additionally to position the wheelbarrow arms to be retained in outwardly spaced relationship to the adjacent wall. Tool supporting brackets are also mountable on the rack horizontal member at points therealong including that portion of the horizontal member intermediate the wheelbarrow and the wall surface to provide the capability of tool storage immediately behind the wheelbarrow.

Important objectives of the present invention include the provision of a combined wheelbarrow and garden tool storage rack capable of storing several garden tools and a wheelbarrow adjacent a wall surface in a highly compact manner; the provision of a combined wheelbarrow and garden tool storage rack wherein all wheelbarrow and tool supporting instrumentalities are adjustable along their respective rack members to adapt to a wide variety of tools and wheelbarrow sizes; the provision of a wheelbarrow and garden tool storage rack permitting tool removal from a wheelbarrow supporting rack without the necessity of momentarily removing the wheelbarrow.

DETAILED DESCRIPTION OF THE PREFERRED EMBODIMENT

Figures 1, 2, 3, 4, 5:
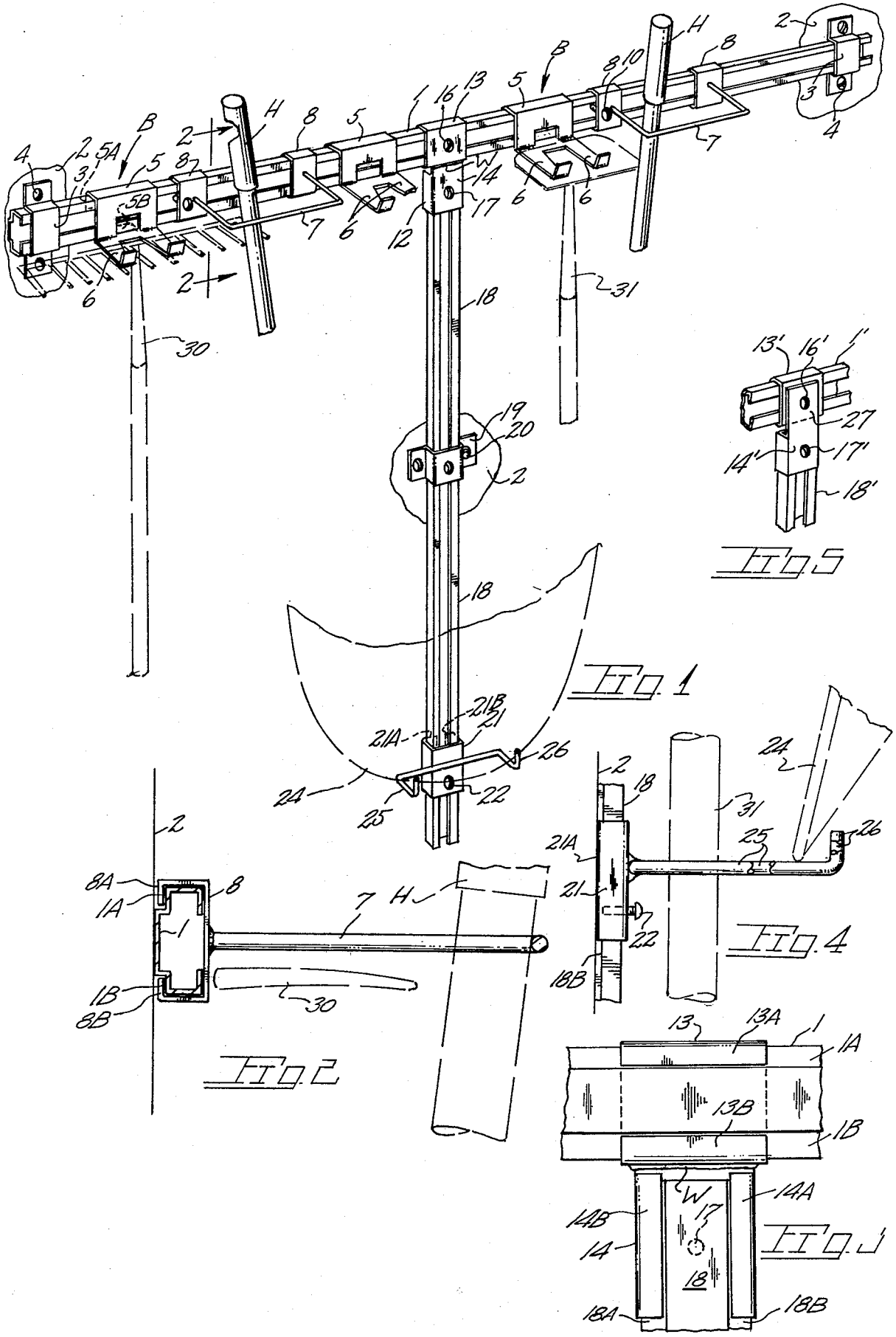
FIG. 1 is a perspective view of the present rack with both tools and wheelbarrow fragments shown in phantom lines.
FIG. 2 is a vertical sectional view taken along line 2—2 of FIG. 1 and showing a wheelbarrow handle supporting bail of the rack.
FIG. 3 is a vertical elevational view of the back side of connector means shown in FIG. 1 joining horizontal and vertical rack components.
FIG. 4 is a side elevational view of a wheelbarrow support member shown supporting a wheelbarrow end in spaced relationship to a wall surface.
FIG. 5 is a fragmentary perspective view of modified connector means.

With continuing attention to the drawing wherein applied reference numerals indicate parts similarly hereinafter identified, the reference numeral 1 indicates a horizontal rack member for securement against an upright wall surface 2 which may be part of a garage or tool shed wall.

Horizontal rack member 1 is supported in place on wall 2 by brackets 3 by means of suitable fasteners at 4. With attention to FIG. 2, it will be seen that the horizontal member is of C-shape having an irregular cross section having inset areas 1A-1B adjacent its rearward upper and lower edges which areas face wall surface 2.

A tool holder bracket is shown generally at B which tool holders conventionally include a sleeve 5 integral with projections 6 which define a tool receiving area therebetween. An upper lip 5A on the sleeve rides in inset area 1A while a lower central lip 5B underlies the rack member. The cross sectional shape of horizontal member 1 and the provision for tool supporting brackets B slidably mounted thereon are previously known and acknowledged to be in the prior art.

With attention now to the novel features of the present rack, a pair of handle receiving bails are indicated at 7 with each bail being slidably mounted by sleeve 8 as best viewed in FIGS. 1 and 2. The bails 7 are of a forward or outward horizontal dimension from their sleeves 8 to permit the positioning of the wheelbarrow handles at H in widely spaced relationship to wall surface 2 for the purposes of tool storage within the space behind the wheelbarrow. Sleeves 8 are slidably adjustable along rack member 1 to accommodate different wheelbarrow handle spacing and when set in place may be secured atainst movement by set screws 10. Sleeves 8 include upper and lower lips 8A and 8B which seat within rack recessed areas 1A and 1B.

As best shown in FIGS. 1 and 3, a connector at 12 comprises C-shaped sleeve structures 13 and 14 secured at right angles to one another as by a weld W. Each sleeve structure of the connector has lips 13A and 13B and 14A and 14B. Set screws 16 and 17 serve as locking means to retain the connector in place along horizontal rack member 1 with the latter set screw serving to retain vertical rack member 18 in place. Rack member 18 also has inset areas at 18A–18B. Additionally, supporting vertical member 18 is a bracket at 19 suitably secured by fasteners 20 to a wall surface.

Adjacent the lower end of vertical member 18 is a sleeve 21 constituting a wheelbarrow support slidably positionable along said member and lockable thereon by means of a set screw 22. Sleeve 21 has rearwardly disposed lips 21A–21B such as the earlier described sleeves. With attention to FIG. 4, it will be seen that the lowermost edge of the wheelbarrow pan 24 (shown in phantom lines) will be supported in place away from wall surface 2 to provide a space within which may be received the various garden tools such as a rack 30 and a hoe 31 being stored on the present rack. The wheelbarrow support includes forwardly projecting arms 25 each terminating in an upturned segment 26.

FIG. 5 discloses a modified sleeve structure 14' which has an upwardly extending flange at 27 which overlies sleeve structure 13' which sleeve structures are joined by locking means such as a set screw 16'. A second set screw 17' secures rack member 18' in place.

While we have shown but a few embodiments of the invention it will be apparent to those skilled in the art that the invention may be embodied still otherwise without departing from the spirit and scope of the invention.

Having thus described the invention, what is claimed and desired to be secured under a Letters Patent is:

1. A combination wheelbarrow and garden tool storage rack for wall attachment, said rack comprising in combination, a horizontal rack member, means for securing said rack member in abutment with a wall surface, a vertical rack member in intersecting relationship with the horizontal rack member, connector means retaining the vertical rack member in intersecting relationship with said horizontal rack member, said connector means comprising C-shaped sleeves permanently secured to one another in perpendicular relationship, locking means carried by each of said sleeves and serving to secure a rack member and sleeve against movement, tool supporting brackets slidably supported supported for selected positioning along the horizontal member of the rack, sleeve mounted bails slidably supported by the horizontal rack member and positionable therealong to each receive a wheelbarrow handle and to retain same in outward spaced relationship to a rack supporting wall surface, a wheelbarrow support slidably attachable to the vertical rack member and including an outwardly projecting support for the retention of the lip of a wheelbarrow pan, and said sleeve mounted bails extending outwardly from said rack member a horizontal distance so as to support the wheelbarrow in spaced relationship to the wall to permit the storage of garden tools on said brackets between the wheelbarrow and the wall.

2. The rack claimed in claim 1 wherein said sleeve mounted bails and said wheelbarrow support include threaded means for locking same in place on their respective rack members.

3. The rack claimed in claim 1 wherein one of said sleeves has an upwardly extending flange in overlying securement to a remaining C-shaped sleeve.

* * * * *